US010508792B1

(12) United States Patent
Chen et al.

(10) Patent No.: US 10,508,792 B1
(45) Date of Patent: Dec. 17, 2019

(54) APPARATUS AND METHOD FOR PROTECTING THE OPTICAL SYSTEM OF A LIGHT FIXTURE

(71) Applicant: CHAUVET & SONS, LLC, Sunrise, FL (US)

(72) Inventors: Qing Feng Chen, Guangzhou (CN); An Min Zhao, Guangzhou (CN)

(73) Assignee: Chauvet & Sons, LLC, Sunrise, FL (US)

( * ) Notice: Subject to any disclaimer, the term of this patent is extended or adjusted under 35 U.S.C. 154(b) by 0 days.

(21) Appl. No.: 16/369,759

(22) Filed: Mar. 29, 2019

(51) Int. Cl.
*F21V 9/40* (2018.01)
*F21W 131/105* (2006.01)

(52) U.S. Cl.
CPC ..... *F21V 9/40* (2018.02); *F21W 2131/105* (2013.01)

(58) Field of Classification Search
CPC ..... F21V 9/40; F21W 2131/105
See application file for complete search history.

(56) References Cited

U.S. PATENT DOCUMENTS 5,034,756 A 7/1991 Taira
6,137,958 A 10/2000 Toyoda
8,228,415 B2 * 7/2012 Kudoh ..... H04N 5/238 348/335
8,702,276 B2 * 4/2014 Christoffersen ..... F21S 8/00 362/268
9,690,970 B2 * 6/2017 Wang ..... H04N 5/2254
2012/0008930 A1 * 1/2012 Barley ..... G03B 11/00 396/155
2018/0180865 A1 * 6/2018 Ma ..... G02B 21/22

FOREIGN PATENT DOCUMENTS

WO 2012031598 A1 3/2012

* cited by examiner

*Primary Examiner* — Donald L Raleigh

(74) *Attorney, Agent, or Firm* — Laurence A. Greenberg; Werner H. Stemer; Ralph E. Locher

(57) ABSTRACT

An apparatus and method for covering the optical system of a moving head light fixture with a filter or diffuser when the lighting fixture is turned off is provided. The filter or diffuser is positioned in the optical path between a lighting element and a lens. A retraction device is energized to retract the filter or diffuser from the optical path during normal operation. Upon removal of power to the fixture, the filter mechanism automatically returns the filter or diffuser to its position in the optical path. In this way, the optical system of the fixture can be protected from damage caused by impinging strong light and/or sunlight when the fixture is not in use.

22 Claims, 7 Drawing Sheets

APPARATUS AND METHOD FOR PROTECTING THE OPTICAL SYSTEM OF A LIGHT FIXTURE

BACKGROUND OF THE INVENTION

1. Field of the Invention

The present invention relates to an apparatus and method for automatically covering the optical system of a moving head light fixture with a light filter or diffuser to block impinging light, including sunlight, when the light fixture is unpowered.

2. Description of the Related Art

Moving head light fixtures or "moving heads" are light fixtures that are able to rotate and tilt the whole head via electronic control signals in order to vary the direction of the outputted light without physically repositioning the fixture. Among other things, moving head light fixtures include an optical system, which includes a light source, such as a lamp or LED, disposed behind one or more lenses. Certain of these light fixtures are IP (Ingress Protection) rated for outdoor use. During outdoor productions, the lighting fixture heads are often pointed upwards when the device is powered off, or when the fixture is powered on, but not outputting light for a period of time. For example, as illustrated in FIG. 1, moving head 10 is pointed in the upright position, at power-off. However, sunlight beaming in the direction of a light fixture lens will shine through the lens and damage the optical system and/or light source of the light fixture. More particularly, the front lens 20 can focus and concentrate light from the sun 30, in the same way as a magnifying glass. Thus, strong light passing through the lens 20, into the body of the light fixture 10, can cause internal damage to the light fixture. At present, light fixture users are advised not to leave the light fixture 10 pointed directly at the sun 30 or at other strong lights. To prevent damage from sunlight or other strong light sources, users frequently cover lights with garbage bags and other objects.

Additionally, there are currently moving head light fixtures that include a motorized diffuser or homogenizing filter, such as a Frost filter, to convert a tight light beam to a softer, muted wash light for different applications. In such fixtures, a motor is used to move the filter in and out of the optical path between the fixture's optical system and lens. More particularly, once the filter is called for, i.e., as part of a stored program, from a signal manually entered on the fixture's user input, or by a wired DMX, sACN, ArtNet signal or a wireless WDMX signal, an internal motor is used to move the filter into the optical path between the outer lens of the light fixture and the light source. The motor is then used to move the filter back out of the optical path when it is no longer requested. When the fixture is powered off, the filter remains in its last physical position, either moved into the optical path, if it was in use at the time of power-off, or outside of the optical path if it was not in use. In some prior art fixtures, the filter is normally-biased out of the optical path so that it will retract out of the optical path when the fixture is powered off.

There is a need in the art for a new and improved apparatus and method in which the optical system and light source of a light fixture are protected from damage from direct sunlight or other intense light rays magnified though the lens. Any such system, apparatus and method should protect the light fixture optical system and light source at a low cost, without enlarging or increasing the weight of the light fixture, and be automatically engaged at power off of the light fixture, or if the fixture is powered on, but pointing upwards with no light being output for a predetermined period of time.

BRIEF SUMMARY OF THE INVENTION

The present invention is particularly suited to overcome those problems that remain in the art in a manner not previously known or contemplated. It is accordingly an object of the invention to provide an apparatus and method that protects the optical system and light source of a light fixture from damage caused by strong light entering and being magnified by the lens. In one particular embodiment of the invention, a filter or diffuser is normally-biased to extend into the optical path of the light fixture between the outer lens and the remainder of the optical system when the light fixture is powered off. In this particular embodiment, a motor is provided to retract the filter from between the outer lens and the other components of the optical system when the light fixture is powered and when the operation of the light fixture does not otherwise particularly call for its use. In another particular embodiment of the invention, the filter or diffuser is normally-biased to extend into the optical path of the light fixture between the outer lens and the remainder of the optical system when the light fixture is powered with the lens pointed upward for a predetermined length of time.

Although the invention is illustrated and described herein as embodied in an apparatus and method for mechanically covering the optical system of a light fixture with a filter or diffuser, it is nevertheless not intended to be limited to moving head light fixtures or the details shown, since it may be used with other types of light fixtures and various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings in which like reference numerals indicate like parts throughout the several views thereof.

DETAILED DESCRIPTION OF THE INVENTION

It is accordingly an object of the invention to provide an apparatus and method for mechanically covering the optical system of a light fixture with a filter or diffuser when the lighting fixture is turned off or pointed upward for a predetermined period of time. In this way, the optical system of the fixture can be protected from being damaged by strong light and/or sunlight when the fixture is not in use.

Figure 1:
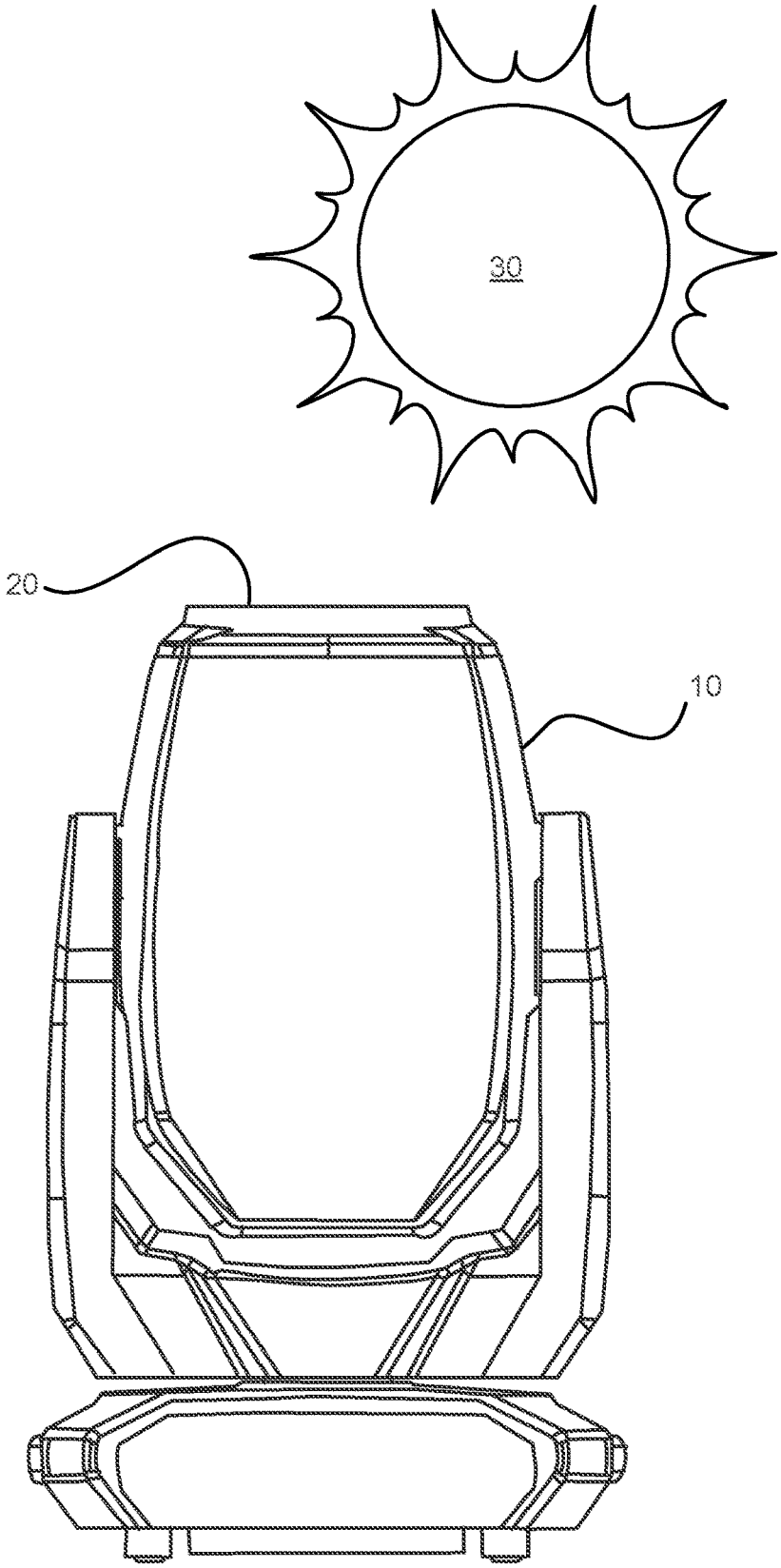
FIG. 1 (PRIOR ART)
FIG. 1 is a simplified illustration representing a prior art, IP-rated moving head light fixture in an outside environment.
Figure 2B:
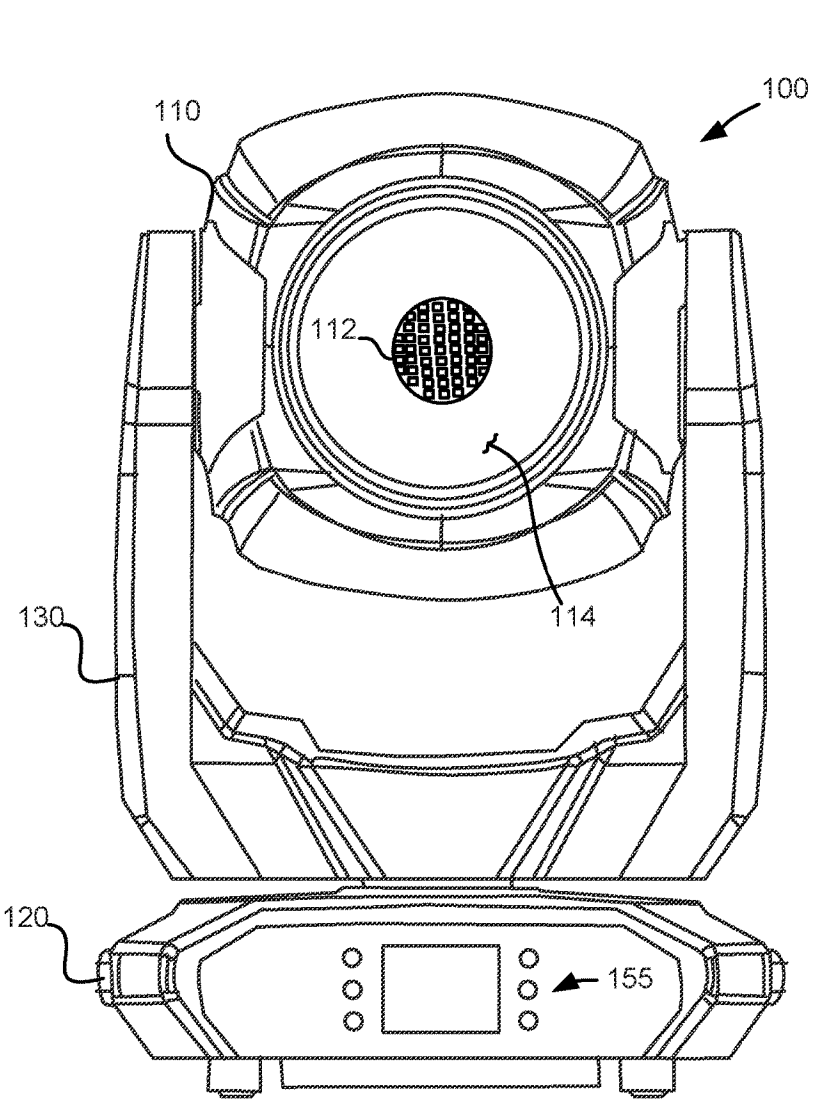
FIG. 2B is a simplified illustration of an IP-rated, moving head light fixture in a horizontal pointing position, in accordance with one particular embodiment of the invention, having a filter retracted from between an optical system and a lens of the fixture.
Figure 2A:
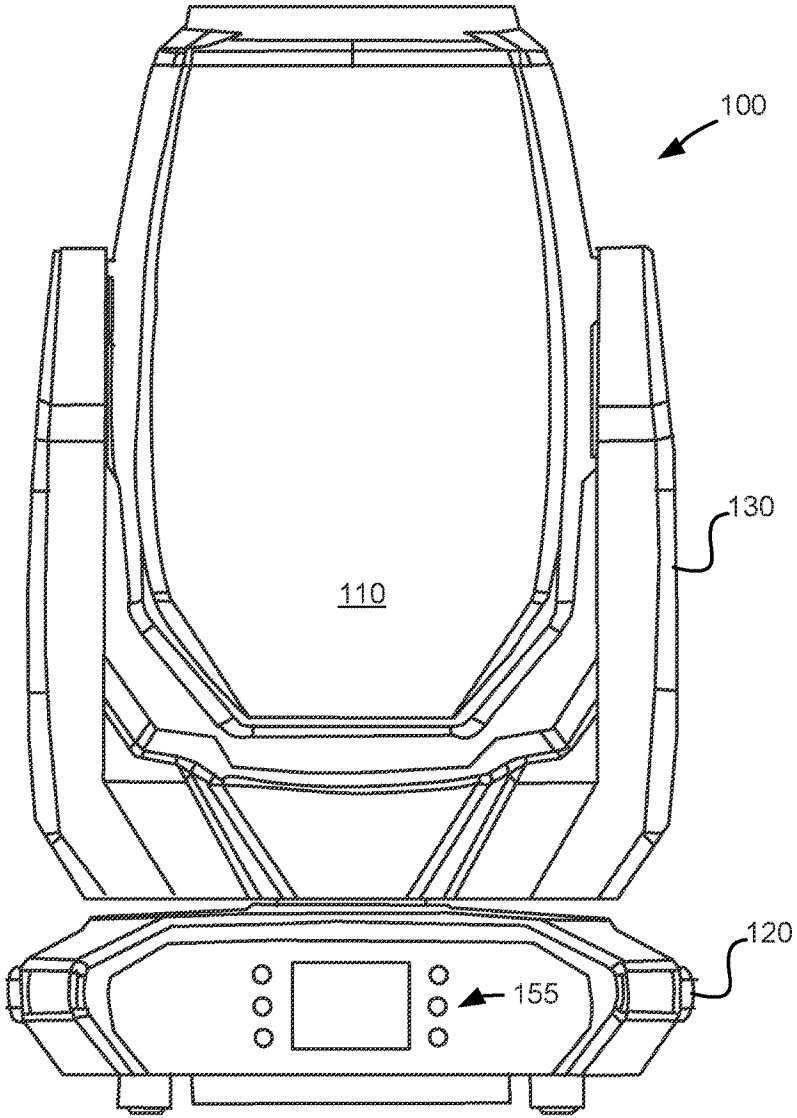
FIG. 2A is a simplified illustration of an IP-rated, moving head light fixture in an upright pointing position, in accordance with one particular embodiment of the invention.
Figure 2D:
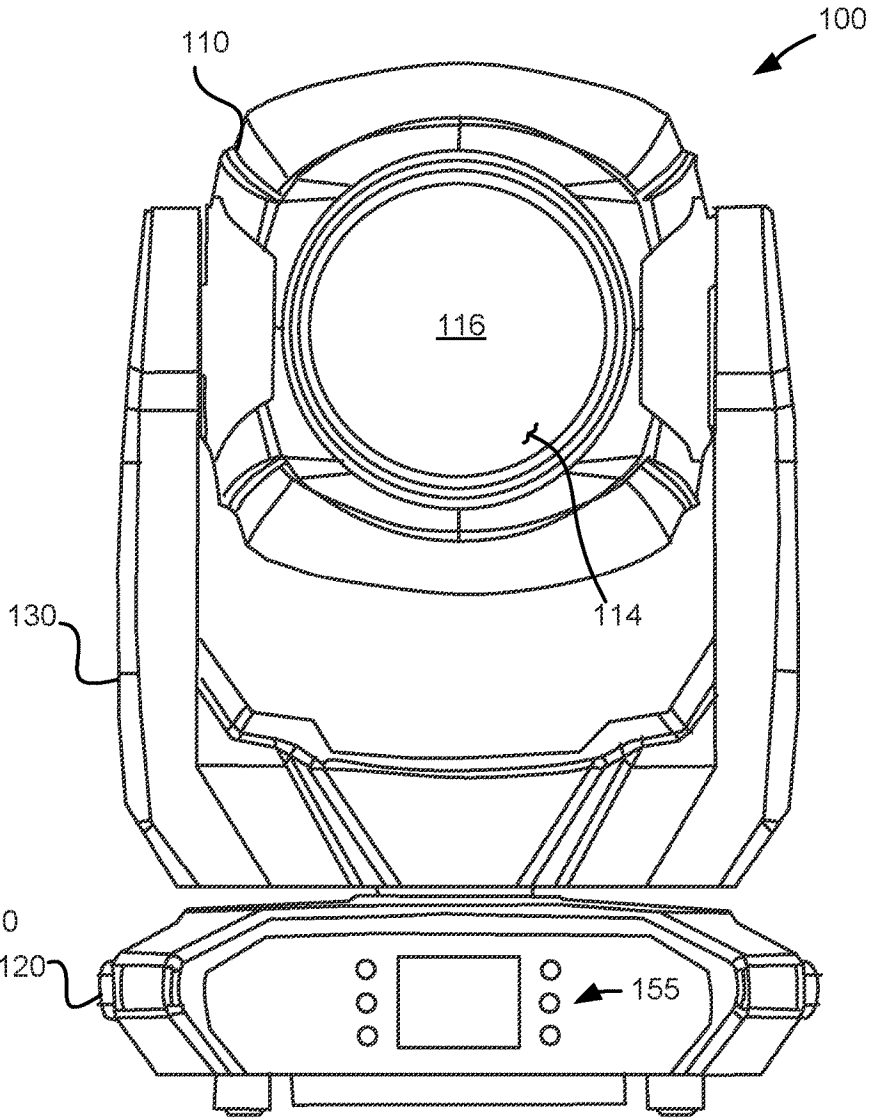
FIG. 2D is a simplified illustration of the moving head light fixture of FIG. 2B having a filter moved fully in between an optical system and a lens of the fixture, in accordance with one particular embodiment of the invention.
Figure 2C:
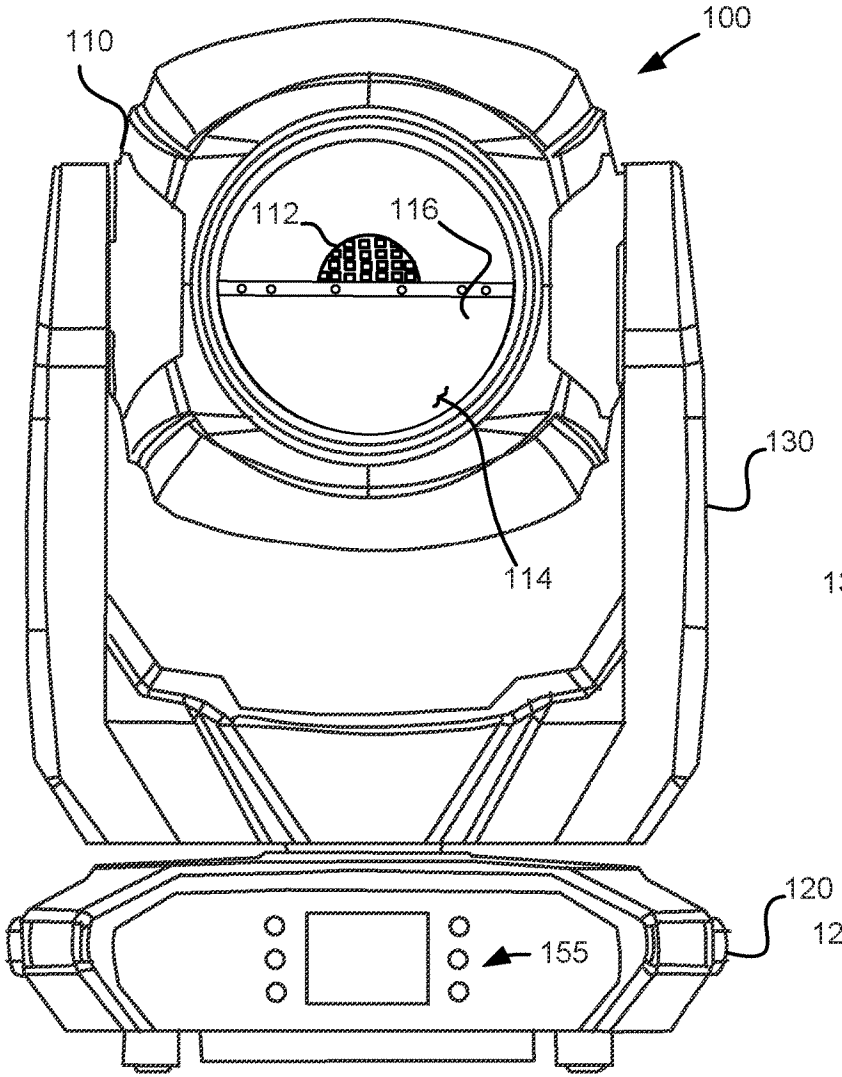
FIG. 2C is a simplified illustration of the moving head light fixture of FIG. 2B having a filter moved partially in between an optical system and a lens of the fixture, in accordance with one particular embodiment of the invention.
Figure 3:
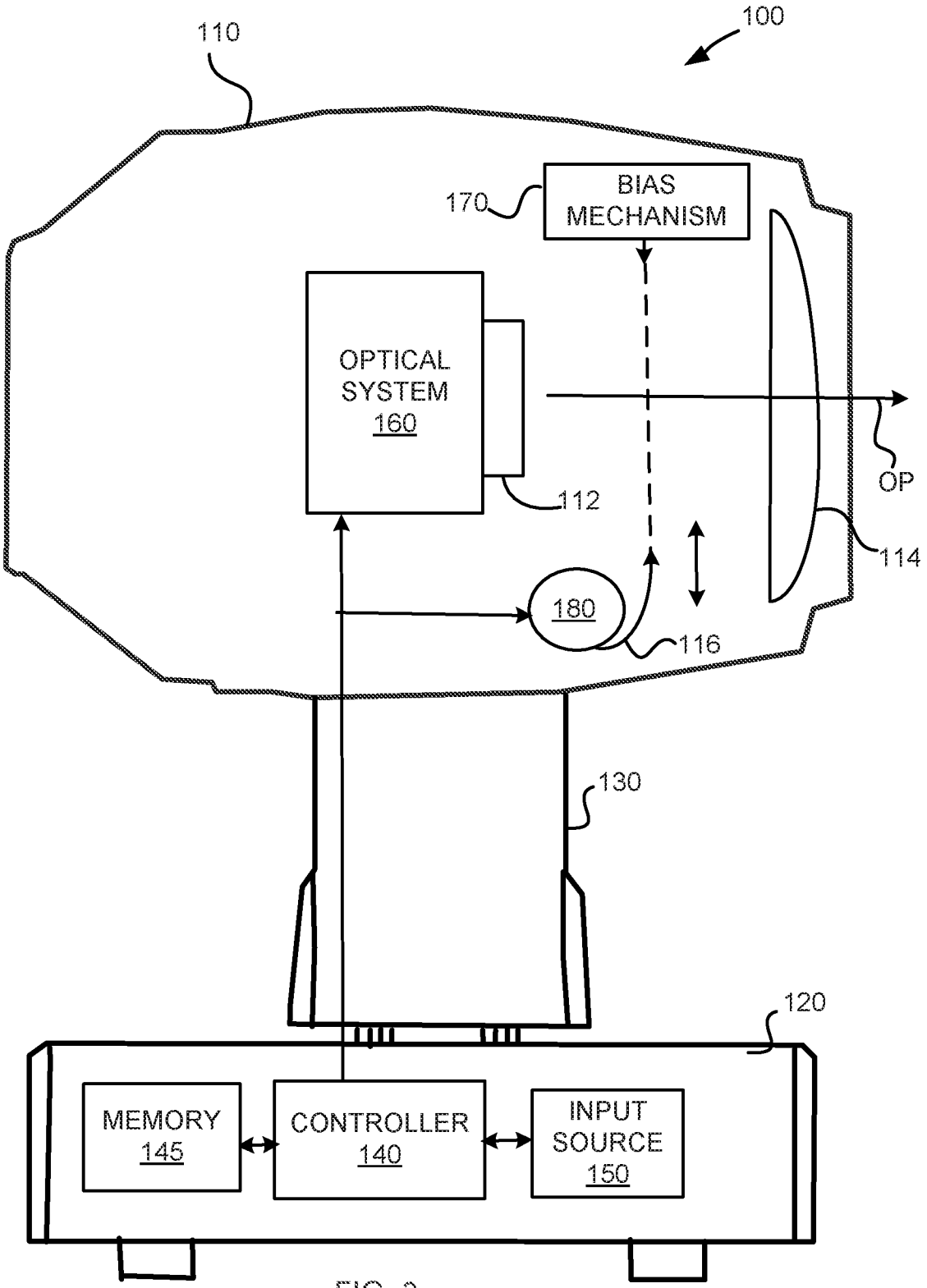
FIG. 3 is a simplified, cross-sectional illustration and schematic diagram of a moving head light fixture in accordance with one particular embodiment of the present invention.

Referring now to FIGS. 2A-3, there is shown one particular embodiment of a moving head light fixture 100 including a normally-biased filter mechanism. More particularly, the moving head light fixture 100 includes a moving head 110 attached to a base 120, via a yoke 130. The moving head 110 and yoke 130 move relative to the base. See, for example, U. S. Patent Application Publication No. 2015/0003099 disclosing one such exemplary moving head light fixture and its components, that patent application being incorporated herein, by reference.

Among other things, the moving head 110 includes a lighting element 112, which is part of an optical system 160, disposed behind a lens 114. In one particular embodiment, the lighting element 112 is formed by a plurality of LEDs configured as part of an optical system 160. A controller 140 is contained in the base in data communication with an input source 150, which can be a user interface 155 on the body of the fixture 100, or can be a source of receiving wired or wireless control signals from a source outside the fixture 100, such as DMX, sACN, ArtNet or WDMX signals, via an interface. Additionally, the controller 140 can receive control signals from a memory 145, to cause the fixture 110 to execute pre-programmed lighting effects. Among other things, the controller 140 provides control signals to the optical system 160 in the head 110, in order to perform certain desired lighting effects. For purposes of the present description, the terms "control data" and "control signals" are used interchangeably herein. Additionally, the terms "light", "lighting fixture" and "light fixture", in the singular or plural, are used interchangeably herein, except where indicated to the contrary. In one particular embodiment of the invention, the light fixtures are used to provide stage lighting and/or theatrical light effects. Additionally, the terms "diffuser", "diffusion filter" and "filter" are used interchangeably herein, to mean a filter that reduces the light or some wavelengths of the light passing through it. Additionally, the terms "powered off", "power down", "powered down" and "power down condition" are used interchangeably herein to refer to a state in which either power has been cut off to the light fixture or a controller of the light fixture has received a control signal requesting that the light fixture be turned off (i.e., powered down).

Additionally, the light fixture 100 includes one or more movable diffusers or filters internal to the moving head 110, to perform certain desired lighting effects. In the present particular embodiment, at least one filter 116 is movably positioned between at least the lighting element 112 of the optical system 160 and the outermost lens 114 of the moving head 110. In one particularly preferred embodiment, the filter 116 is a diffusion filter provided in the moving head 110 for diffusing a light beam passing therethrough. In another embodiment of the invention, the filter 116 is a Frost filter housed in the head 110.

In prior art fixtures having one or more filters, such as filter 116, in the head, filters are intentionally moved into and out of the optical path between the optical system and the lens, as required. For example, when needed, a motor is used to move the filter into the optical path between the lens and the optical system until such time as it is no longer needed. Then, the motor is again used to move the filter out of the optical path. In some prior art fixtures, the filter will remain in its last physical position at the time the fixture was powered down. If the filter was outside the optical path at the time of power-down, that is where it will remain. In other prior art fixtures, the filter is normally-biased out of the optical path so that, if the filter is in the optical path at the time the fixture is powered off, it will retract out of the optical path when powered off.

In contrast, the present invention provides a light fixture including a device that is configured to interpose a filter into the optical path between the optical system and the outermost lens when the light fixture is powered down. In one particular embodiment of the invention, the light fixture includes a mechanism wherein at least one filter 116 is normally-biased by a bias mechanism 170 into the optical path OP between at least a portion of the optical system 160 including the lighting element 112 and the lens 114, and no power is required to keep it there. In another particular embodiment of the invention, upon receiving a signal to power down the light fixture, the controller can delay power-down of the fixture until after the controller has actuated a motor to move the filter into the optical path.

Referring back to FIGS. 2A-3, in one particular embodiment of the invention, power is required to bias the filter 116 out of the way of the optical path. In this way, the filter 116 can be completely engaged between a portion of the optical system 160 and the lens 114 when there is no power to the fixture 100 (i.e., the fixture 100 is powered off), in order to block or diffuse sunlight or other strong light entering through the lens 114, and protect the optical system 160 from damage.

In the particular embodiment shown in FIG. 3, a retraction device 180 is powered to counter-act the normal bias exerted by the bias mechanism 170, in order to move the filter into the optical path OP between the optical system 160 and the lens 114. For example, in one particular embodiment of the invention, the bias mechanism includes a spring that normally spring biases the filter 116 into the optical path OP. In one embodiment, the retraction device 180 is a motor that is activated by the controller 140 to counteract the spring bias on the filter 116, and remove the filter 116 from the optical path OP between the optical system 160 and the lens 114.

Note that it is not intended that the invention be limited only to the use of a spring and motor, as described above. Rather, other bias mechanisms 170 and counteracting retraction devices 180 are possible without departing from the scope and spirit of the present invention. For example, the bias mechanism 170 can also be selected from such bias mechanisms including, but not limited to, a spring, a relay, a magnet, etc. Correspondingly, the counteracting retraction device 180 could be a motor, a relay or other electromechanical device, an electromagnet, etc., that counteracts the normal bias applied to the filter 116.

Figure 4A:
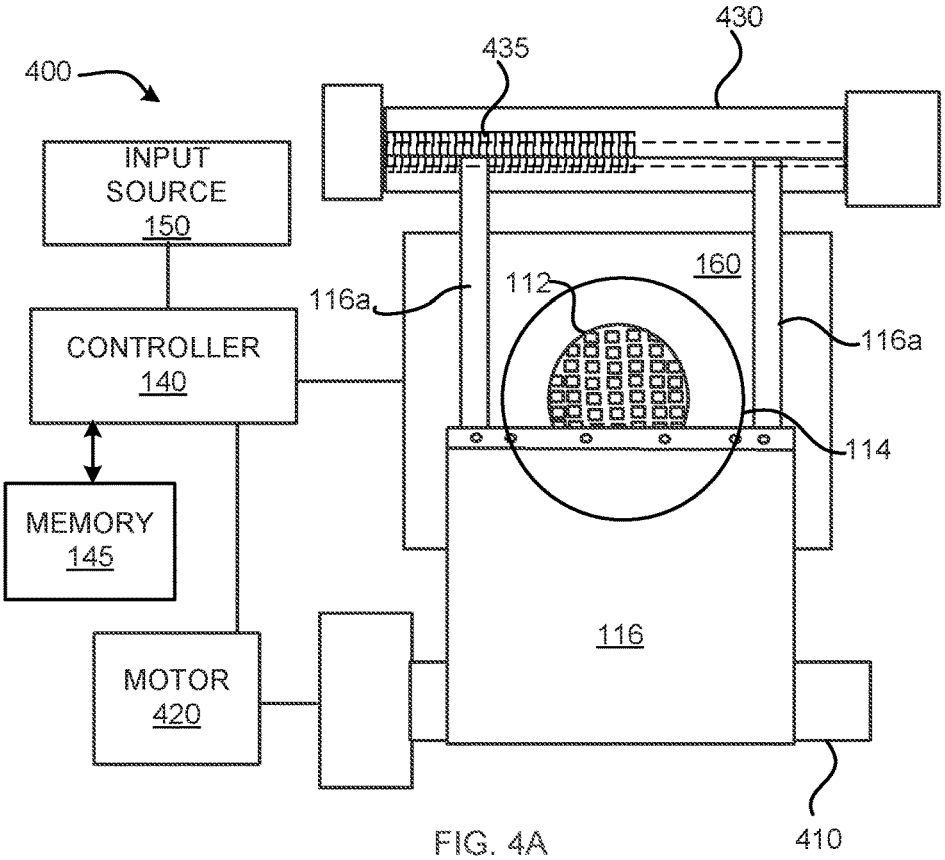
FIG. 4A is a simplified schematic illustration of a moving head light fixture filter engagement mechanism in accordance with another particular embodiment of the present invention.

Referring now to FIG. 4A, there is shown a system 400 in accordance with one particular embodiment, in which a filter 116 is normally-biased across the optical path of a moving head. More particularly, the filter 116 is mounted at one end to a roller 410 located on one side of the optical system 160. The roller 410 is driven by a motor 420. At its other end, the filter 116 is connected to a spring-biased roller 430 located on a side of the optical system 160 opposite from the roller 410. Spring-biased roller 430 is configured to operate like a window roller shade. In other words, the roller 430 is biased by a coiled spring 435, that draws the filter 116 across the optical path, between the optical system 160 and the lens, when no force is applied to the filter by the motor operated roller 410. More particularly, the filter 116 is attached to the spring-biased roller 430 by the straps 116*a*, which are affixed to a leading edge of the filter 116 and are arranged to be outside of the optical path.

While power is applied to the fixture and there is not a call for the filter 116, the controller 140 provides control signals to energize the motor 420 to roll the filter 116 onto the motor-driven roller 410 and out of the optical path. The unrolling of the filter 116 from the spring-biased roller 430 applies a torsion force to the spring 435 that is maintained so long as the motor 420 is operated. The motor 420 is operated to maintain tension on the roller 410, until such time as the controller has instructed the motor to do so (i.e., because the filter 116 is called for as part of a program or in response to an input signal) or until power has been cut off to the fixture. Once the motor 420 stops driving the roller 410 and releases tension thereon, the stored torsional energy in the spring 435 is released and the spring-biased roller 430 turns, drawing the filter 116 over the optical system 160 and lighting element 112, in order to conceal them from light entering the moving head via the lens. Once power is restored to the fixture, the controller 140 again energizes the motor 420 to roll the filter 116 onto the roller 410 and out from between the lighting element 112 and the lens, until such time as the filter 116 is called for, or until power is again removed from the fixture.

Figure 4B:
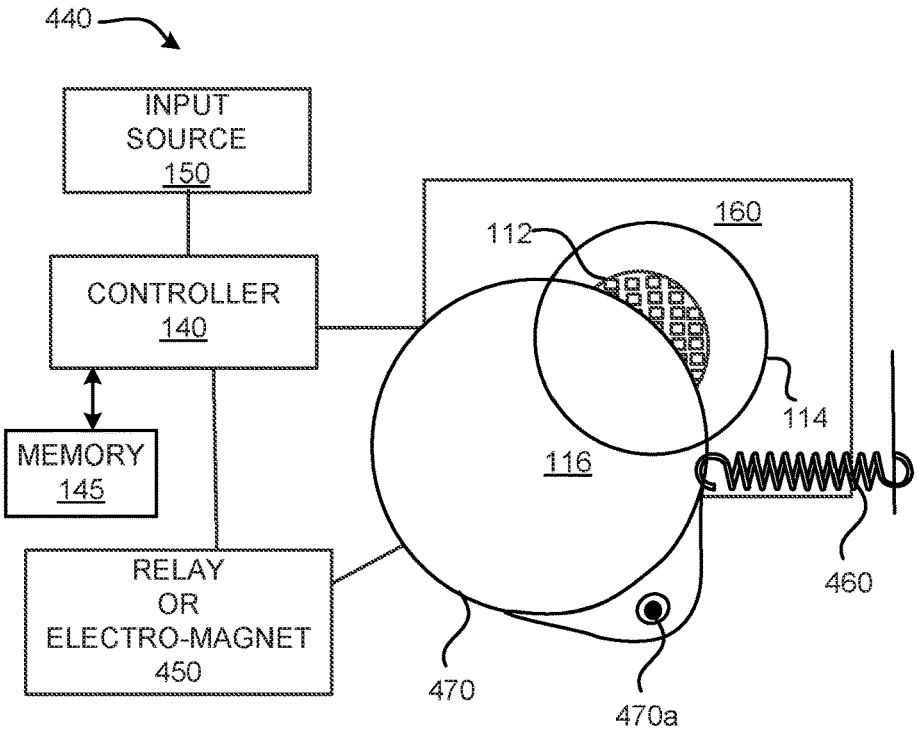
FIG. 4B is a simplified schematic illustration of a moving head light fixture filter engagement mechanism in accordance with a further particular embodiment of the present invention.

Referring now to FIGS. 3 and 4B, in another embodiment of the invention, in which the filter 116 of the system 440 can be provided on a pivoting frame or plate 470 that is normally disposed in the optical path (i.e., perpendicular to the beam direction from the lighting element 112), between the lens and the optical system 160 including the lighting element 112. A bias mechanism 170, such as a spring 460, or a magnet or another bias mechanism not requiring power, maintains the filter 116 in front of the lighting element. Upon power being applied to the fixture, the controller 140 energizes a retraction device 180, such as relay or electro-magnet 450, that operates to pivot the frame about the pivot point 470*a* and remove it from in front of the lighting element 112 and out of the optical path between the lighting element 112 and the lens. When power is removed from the fixture (or by the controller 140 in response to a control signal) the relay or electro-magnet 450 is de-energized and the frame 470 is pivoted back into the optical path by the bias mechanism 460.

Note that other mechanisms for biasing the frame 470 in and out of the optical path may be used. For example, the relay 450 can be provided as both the bias mechanism 170 and the powered retraction device 180. In such an embodiment, energizing the relay 450 would retract the frame 470 from the optical path, while in its normally de-energized state, a relay arm could push the frame 470 back into the optical path as the bias mechanism 170, without a spring 460.

In the case where the device 450 is an electro-magnet the frame 470 can be provided with a ferromagnetic element, such that, upon energization of the electro-magnet by the controller 140, the frame is pivoted and the filter 116 removed from in front of the lighting element 112. Upon de-energizing the electro-magnet, a bias mechanism, such as spring 460, or a regular magnet, etc., can be used to pivot the frame 470 and return the filter 116 in front of the lighting element 112.

It can be seen how this is not meant to be limiting. For example, other mechanisms for moving the frame out of the optical path and biasing it back into the optical path in an unpowered state, can be used. For example, a motor and associated gearing arranged on the frame 470 could additionally be used to drive the frame 470 out of the optical path, while a spring 460 or other bias mechanism 170 can be used to pivot the frame back into the optical path when the motor is de-energized.

Figure 5:
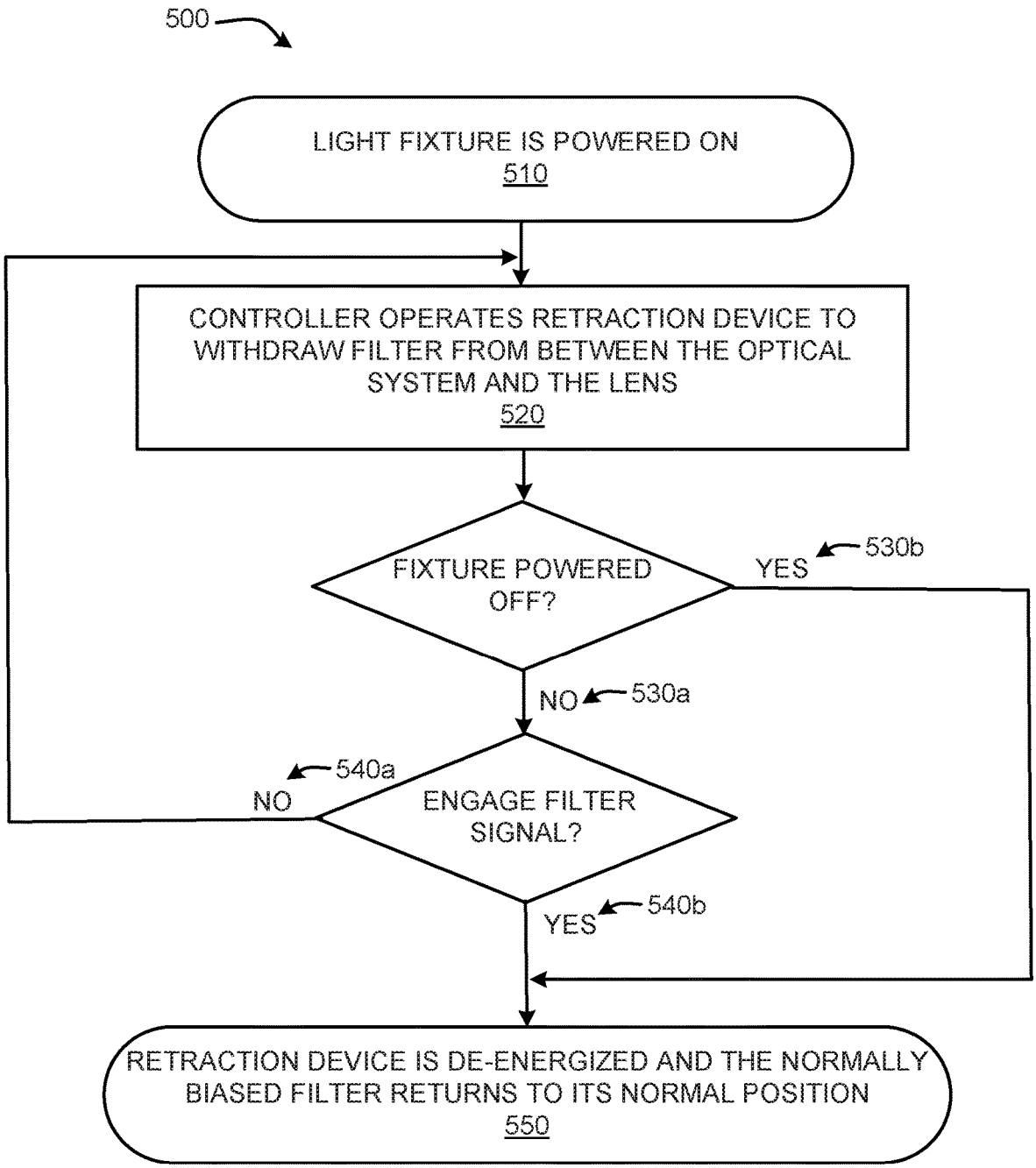
FIG. 5 is a flow diagram useful in understanding a method for using a filter engagement mechanism in accordance with one particular embodiment of the invention.

Referring now to FIGS. 3 and 5, there will be described one particular embodiment of a method 500 for moving a filter 116 in and out of the optical path of a lighting fixture to protect the optical system of the fixture from damage by impinging light. More particularly, a moving head light fixture 100 is provided having a filter 116 that is normally-biased to cover at least a portion of the optical system 160 of the fixture 100, when in the unpowered state. Upon powering on the light fixture 100 (step 510), the controller is programmed to automatically operate the retraction device 180 to withdraw the filter 116 from between at least a portion of the optical system 160 including the lighting element 112 and the lens 114. Step 520. So long as the fixture 100 is powered on (Step 530*a*) and the controller does not receive a signal to provide the filter 116 into the optical path (Step 540*a*), the retraction device 180 is activated to maintain the filter 116 out of the optical path between the lighting element 112 and the lens 114 (Step 520). However, if the fixture 100 is powered off (Step 530*b*), the retraction device 180 is de-energized, and the filter 116, under the influence of the bias mechanism 170, returns to its normal position in the optical path between at least a portion of the optical system 160 including the lighting element 112 and the lens 114 (Step 550), until such time as power is restored to the light fixture 100 (Step 510). Similarly, if the controller 140 receives a control signal calling for the use of the filter 116 from an input source 150 or a program from memory 145 (Step 540*b*), the controller de-energizes the retraction device 180 to return the filter 116 to its normally-biased position in the optical path (Step 550), until such time as the controller re-energizes the retraction device 180 to retract it (step 520) in response to a received control signal.

Figure 6:
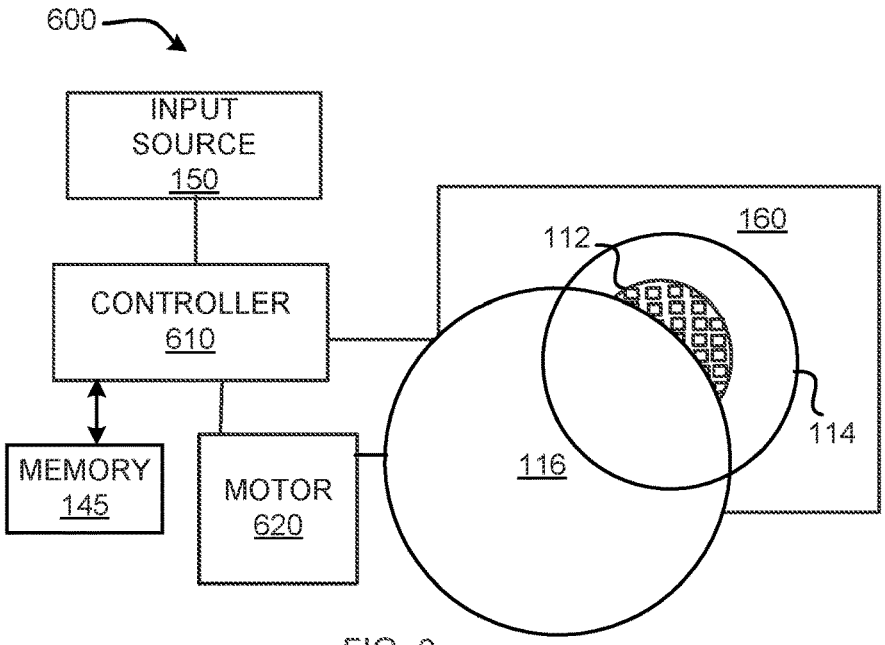
FIG. 6 is a simplified schematic illustration of a moving head light fixture filter engagement mechanism in accordance with another particular embodiment of the present invention.
Figure 7:
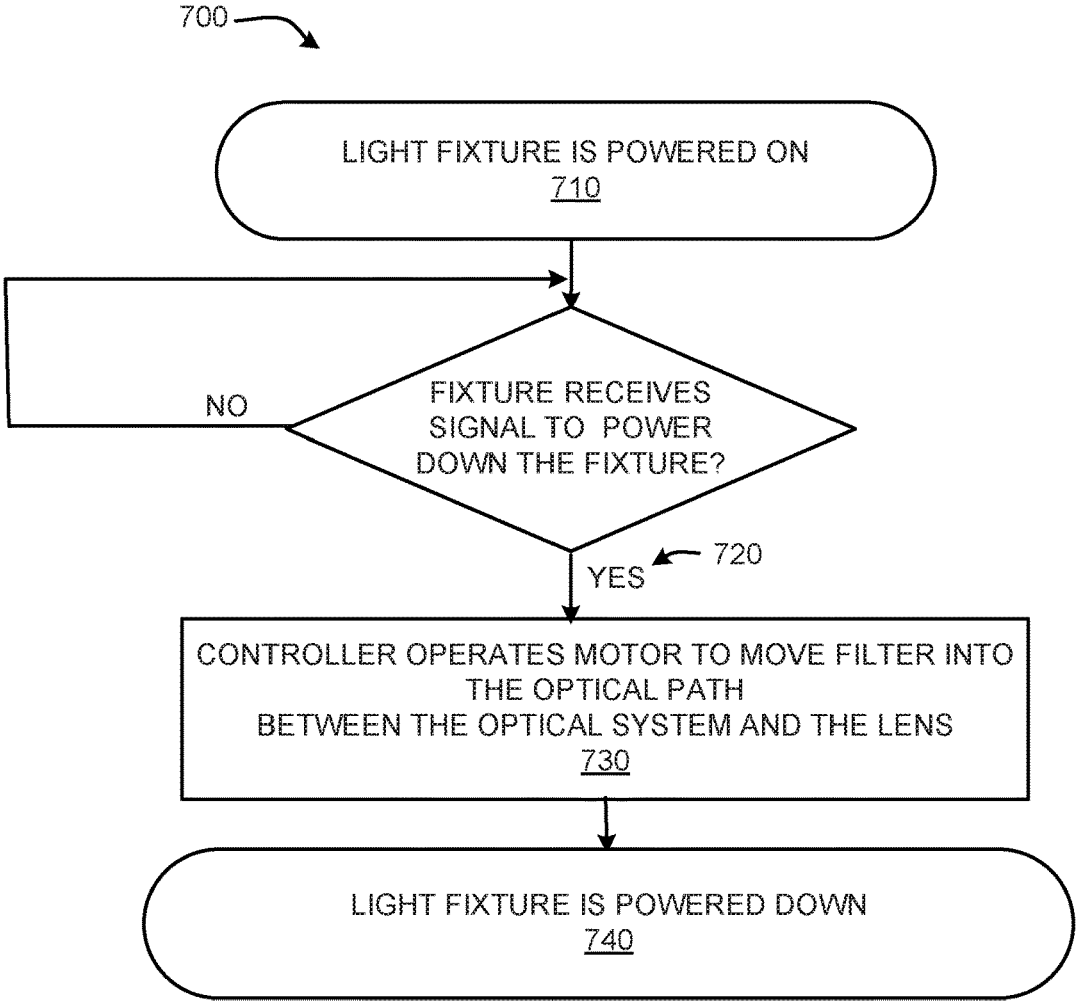
FIG. 7 is a flow diagram useful in understanding a method for using a filter engagement mechanism in accordance with another particular embodiment of the invention.

Referring now to FIGS. 6 and 7, there is shown another embodiment of the invention, in which a light fixture 600 includes a controller 610 that is specially configured by software stored in non-transitory memory 145, to perform a method 700 to move a filter 116 into the optical path between the optical system 160 and outermost lens 114, when the controller 610 receives a signal to power down the fixture 600. More particularly, while the light fixture 600 is powered on, the controller 610 controls the motor 620 to move the filter 116 into, or out of, the optical path between the optical system 160 and the outermost lens 114, in a normal manner, as desired. Step 710. However, upon receiving a signal to power down the light fixture 600 (Step 720), the controller 610 first, before removing power to the fixture 600, controls the operation of the motor 620 in order to insert the filter 116 into the optical path between at least a portion of the optical system 160 and an outermost lens 114 of the fixture 600. Step 730. Gearing, for example, a rack and pinion gear system, can be provided to move the filter 116 in and out of the optical path in a known way. After the motor 620 has positioned the filter 116 in the optical path between the optical system 160 and the outermost lens 114, to reduce the strength of any light passing through the lens 114, the light fixture 600 is powered down. Step 740.

In another particular embodiment of the invention, the system is configured to position a filter into the optical path between the optical system 160 and the outermost lens 114 when the light fixture is powered with the lens pointed upward for a predetermined length of time. More particularly, if desired, the controller 140 of the embodiment of FIG. 3 can be configured to release the tension applied by the retraction mechanism 180 and permit the normally-biased filter 116 to be moved back into the optical path, even when the light fixture 100 is powered on, if the lens has been pointed upward for a predetermined length of time. Similarly, if desired, the controller 610 of the embodiment of FIG. 6 can be configured to operate the motor 620 to move the filter 116 into the optical path between the optical system 160 and the outermost lens 114, if the lens has been pointed upward for a predetermined length of time, even when the light fixture 600 is powered on and no power down signal has been received. Such a predetermined length of time can be programmed into the controller 140, 610 at the factory or using an input source 150.

Additionally, in a further embodiment not illustrated, if desired, the filter or diffuser can be replaced by an opaque shutter or opaque member that is normally-biased into the optical path, as described herein above, and which is retracted from the optical path upon powering of the fixture by a retraction device, in the same manner as described herein.

Although the invention is illustrated and described herein as embodied in an apparatus and method for mechanically covering the optical system of a light fixture with a filter or diffuser, it is nevertheless not intended to be limited to the details shown, since various modifications and structural changes may be made therein without departing from the spirit of the invention and within the scope and range of equivalents of the claims.

We claim:

1. A filter apparatus for a light fixture including a lens and a lighting element controlled by a controller, comprising:

a light filter movable into an optical path between the lighting element and the lens, in use, under control of the controller during execution of a light program; and the filter apparatus configured to automatically move said light filter from a position outside the optical path to a position within the optical path upon power down of the light fixture.

2. The filter apparatus of claim 1, wherein the controller is configured, in response to receiving a signal to power down the light fixture, to move the light filter into the optical path before powering down the light fixture.

3. The filter apparatus of claim 2, further comprising a motor operated by the controller to move the light filter into the optical path after the controller receives a signal to power down the light fixture and before the light fixture is powered down.

4. The filter apparatus of claim 1, wherein:

the filter apparatus further includes a retraction device configured to retract said light filter from said optical path when said retraction device is activated;

said light filter is normally-biased into an optical path between the lighting element and the lens; and said controller is configured to activate said retraction device upon power being provided to the light fixture in the absence of a request by the light program for said light filter.

5. The filter apparatus according to claim 4, wherein said light filter is a Frost filter.

6. The filter apparatus according to claim 4, further comprising a bias mechanism providing the normal-bias to the light filter.

7. The filter apparatus according to claim 6, wherein said bias mechanism includes a spring.

8. The filter apparatus according to claim 7, wherein said bias mechanism includes a spring-biased roller located on one side of the lighting element, at least a portion of said filter being attached to said spring-biased roller.

9. The filter apparatus according to according to claim 8, wherein said retraction device includes a motor and a roller driven by said motor, said roller located on another side of the lighting element opposite the spring-biased roller, a second portion of said filter being attached to said motor-driven roller, wherein operation of said motor rolls a portion of said filter around said motor-driven roller and applies a torsional force to said spring.

10. The filter apparatus according to claim 4, wherein said retraction device includes a relay.

11. The filter apparatus according to claim 4, wherein said retraction device includes an electromagnet.

12. The filter apparatus according to claim 6, wherein the light fixture includes a moving head, and said filter, said bias mechanism and said retraction device are all located in said moving head.

13. A moving head light fixture, comprising:

a moving head including a lens and a lighting element;

a controller configured to control said moving head and said lighting element;

at least one light filter disposed in said moving head, said at least one light filter movable between a first position disposed in an optical path between said lighting element and said lens, and a second position outside the optical path between said lighting element and said lens;

said controller configured to move said at least one light filter between said first position and said second position in response to control signals as part of a lighting program;

said at least one light filter being automatically moved into said first position from said second position when the light fixture is powered down.

14. The moving head light fixture of claim 13, wherein said controller is configured, in response to receiving a signal to power down the light fixture, to move the light filter into the optical path before powering down the light fixture.

15. The moving head light fixture of claim 14, further comprising a motor operated by the controller to move the light filter into the optical path after the controller receives a signal to power down the light fixture and before the light fixture is powered down.

16. The moving head light fixture of claim 13, wherein:

said at least one light filter is normally-biased into said first position; and a retraction device is provided in said moving head and configured to move said at least one light filter from its first position to its second position outside said optical path when said retraction device is activated.

17. The moving head light fixture according to claim 16, wherein said controller is additionally configured to activate said retraction device upon power being provided to the moving head light fixture.

18. The moving head light fixture according to claim 16, wherein said at least one light filter is spring-biased into said first position in an unpowered state.

19. The moving head light fixture according to claim 16, wherein said retraction device includes a motor.

20. The moving head light fixture according to claim 19, wherein said at least one light filter is connected at one end to a spring-biased roller and at another, opposite end to a motor-driven roller, wherein activation so said motor rolls a portion of said filter around said motor-driven roller, moving said at least one light filter to its second position, and wherein de-activation of said motor releases tension on said motor-driven roller and said spring-biased roller pulls said at least one filter into said first position.

21. A method of using a light fixture including a lens and a lighting element controlled by a controller, the method comprising:

providing at least one light filter movable between a first position disposed in an optical path between said lighting element and said lens, and a second position outside the optical path between said lighting element and said lens; and automatically moving the at least one filter from the second position to the first position in response to a power down condition of the light fixture.

22. The method of claim 21, wherein said controller is configured to move the at least one light filter from the first position to the second position when power is initially provided to the light fixture.

* * * * *